US008502637B2

(12) United States Patent
Guarniere et al.

(10) Patent No.: US 8,502,637 B2
(45) Date of Patent: Aug. 6, 2013

(54) SURGE PROTECTIVE DEVICE WITH THERMAL DECOUPLER AND ARC SUPPRESSION

(75) Inventors: Marco Antonio Guarniere, Richmond, VA (US); Martin William Guy, Chester, VA (US)

(73) Assignee: Thomas & Betts International, Inc., Wilmington, DE (US)

( * ) Notice: Subject to any disclaimer, the term of this patent is extended or adjusted under 35 U.S.C. 154(b) by 22 days.

(21) Appl. No.: 13/233,688

(22) Filed: Sep. 15, 2011

(65) Prior Publication Data

US 2012/0068806 A1 Mar. 22, 2012

Related U.S. Application Data

(60) Provisional application No. 61/385,235, filed on Sep. 22, 2010.

(51) Int. Cl.
*H01C 7/10* (2006.01)

(52) U.S. Cl.
USPC ..... 338/21; 361/118

(58) Field of Classification Search
USPC ..... 338/21; 361/118
See application file for complete search history.

(56) References Cited

U.S. PATENT DOCUMENTS

| | | | | |
|---|---|---|---|---|
| RE19,462 | E | | 2/1935 | Ramsey |
| 2,077,429 | A | | 4/1937 | McMahon |
| RE20,450 | E | | 7/1937 | Hill |
| 2,281,073 | A | | 4/1942 | Leonard |
| 2,314,346 | A | | 3/1943 | Craig |
| 2,937,253 | A | | 5/1960 | Smith, Jr. |
| 2,961,515 | A | | 11/1960 | Sankey |
| 3,294,935 | A | | 12/1966 | Leonard et al. |
| 4,058,785 | A | | 11/1977 | Frind et al. |
| 4,082,866 | A | | 4/1978 | Link |
| 4,091,353 | A | | 5/1978 | Fisk et al. |
| 4,161,711 | A | | 7/1979 | Meister |
| 4,170,000 | A | | 10/1979 | Trayer |
| 4,220,942 | A | | 9/1980 | Meister et al. |
| 4,227,170 | A | | 10/1980 | Friedman et al. |
| 4,288,833 | A | * | 9/1981 | Howell ..... 361/124 |
| 6,040,971 | A | * | 3/2000 | Martenson et al. ..... 361/118 |
| 6,430,019 | B1 | | 8/2002 | Martenson et al. |

(Continued)

FOREIGN PATENT DOCUMENTS

| | | | |
|---|---|---|---|
| DE | 20203134 | U1 | 7/2003 |
| DE | 102008026555 | A1 | 12/2009 |
| WO | 2009147043 | A1 | 12/2009 |

OTHER PUBLICATIONS

Extended European Search Report dated Aug. 7, 2012, issued in corresponding EP application No. 11182417.3, 6 pages.

*Primary Examiner* — Kyung Lee
(74) *Attorney, Agent, or Firm* — Snyder, Clark, Lesch & Chung, LLP

(57) ABSTRACT

A device may include a metal-oxide varistor (MOV), wherein the MOV increases in temperature as a voltage applied across the MOV exceeds a rated voltage. The device may include a first conductor contacting the MOV and a second conductor contacting the MOV. The second conductor may be configured to disconnect from the MOV when the MOV reaches a threshold temperature. The device may include an enclosure to surround the MOV, the first conductor, and the second conductor, wherein the enclosure includes a non-conductive fluid to suppress arcing.

22 Claims, 6 Drawing Sheets

U.S. PATENT DOCUMENTS 6,797,909 B2 9/2004 Pride et al.
6,876,533 B1 * 4/2005 Ryan ..... 361/104
7,633,737 B2 12/2009 Ramarge et al.
2010/0027182 A1 * 2/2010 Lindeperg et al. ..... 361/131

* cited by examiner

SURGE PROTECTIVE DEVICE WITH THERMAL DECOUPLER AND ARC SUPPRESSION

RELATED APPLICATIONS

This patent application claims priority to U.S. Provisional Application No. 61/385,235, filed Sep. 22, 2010, which is incorporated herein by reference.

BACKGROUND OF THE INVENTION

A surge protective device, such as a varistor, may be used to protect a circuit against excessive transient voltages. When triggered by a sufficiently high voltage, a varistor, for example, shunts current created by the high voltage away from the circuit it protects. A varistor may be deployed within electronic devices or in a power distribution system (e.g., at the point where an electrical wire enters a building or throughout a building).

DETAILED DESCRIPTION OF THE PREFERRED EMBODIMENTS

One type of surge protection device is a Metal Oxide Varistor (MOV). An MOV may include a ceramic mass of zinc oxide grains, in a matrix of other metal oxides, between two metal plates. The boundary between the grains forms a diode junction, and the operation of an MOV is similar to that of a reversed-biased diode. When a small voltage (e.g., less than the breakdown voltage of the MOV) is applied across the MOV, only a small current flows through the MOV, caused by reverse leakage through the diode junction. When a sufficiently large voltage (e.g., greater than the breakdown voltage of the MOV) is applied across the MOV, the diode junction breaks down due to a combination of thermionic emission and electron tunneling, and current is allowed to flow through the MOV. The result of this behavior is a highly nonlinear current-voltage characteristic, in which the MOV has a high impedance at low voltages and a low impedance at high voltages.

When conducting during a sufficiently-large voltage condition, however, the MOV may heat up significantly and fail catastrophically. To prevent such a catastrophic failure, a contact may be attached to the MOV such that the contact becomes unattached at a sufficiently high temperature. For example, the contact may be soldered to the MOV, in which case the solder may melt at a sufficiently high temperature and spring away from the MOV. As described in more detail below, the contact may also be attached to the MOV with other heat-reactive, conductive material that, for example, softens at a predetermined or a sufficiently high temperature.

Figure 1:
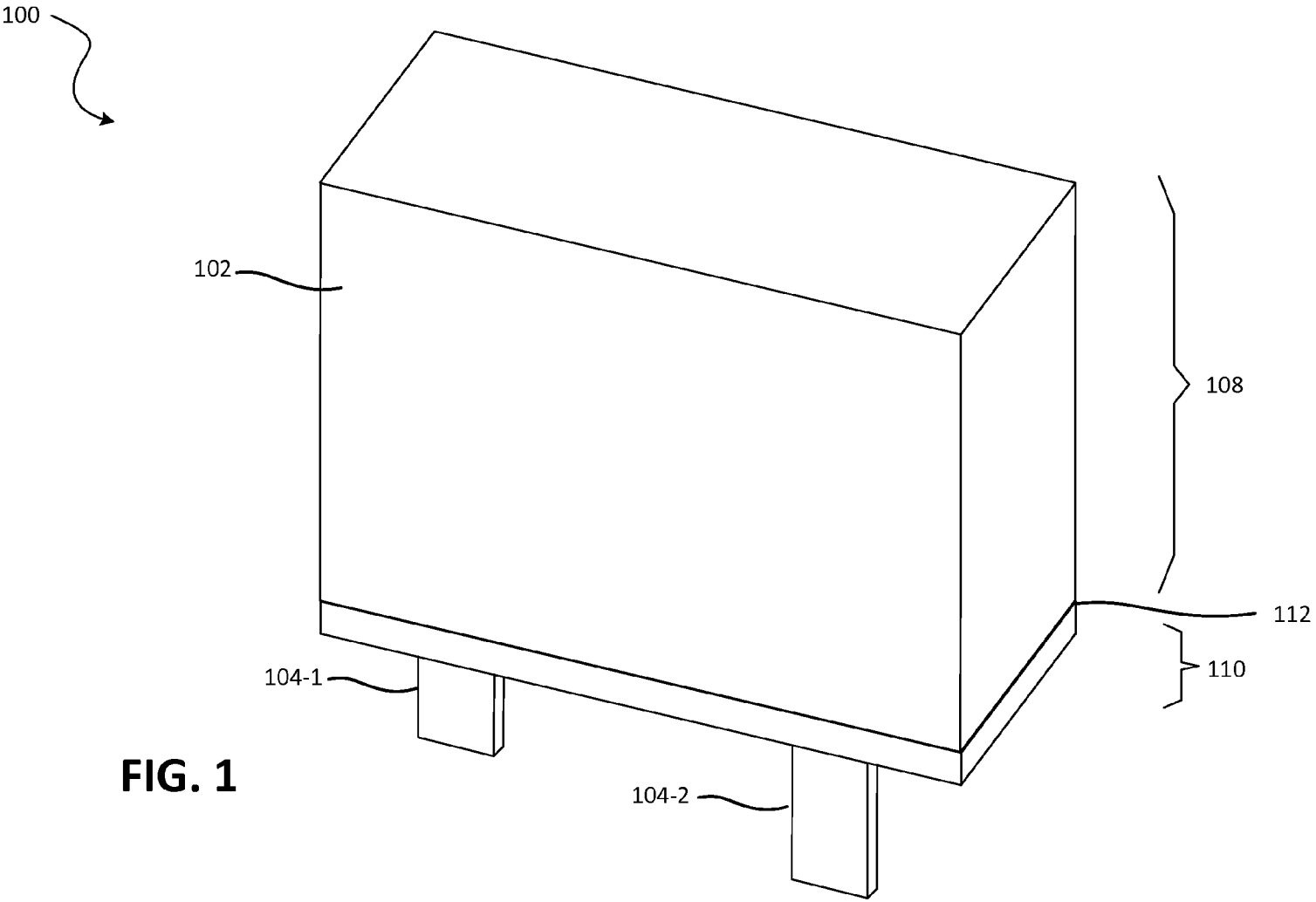
FIG. 1 is an isometric perspective drawing of an exemplary surge protective device in one embodiment in an assembled configuration.

FIG. 1 is an isometric perspective drawing of an exemplary surge protective device 100 in one embodiment in an assembled configuration. Device 100 includes an enclosure 102, a first external contact 104-1, and a second external contact 104-2 (collectively "contacts 104"). In one embodiment, enclosure 102 may include a cover portion 108, a base portion 110, and a seam 112 between the two. Device 100 may be used to protect a circuit against excessive transient voltages by shunting the current created by a high voltage away from the protected circuit. Device 100 may be deployed within an electronic device or in a power distribution system.

For example, device 100 may be connected in parallel between a power line and a ground line, between a power line and a neutral line, between a neutral line and a ground line, or between a power line and another power line. Device 100 may include a metal-oxide varistor (MOV). During normal operating conditions (e.g., non-surge conditions), the impedance between contacts 104 may be extremely high with only a small current flowing between contacts 104 through device 100. When the voltage between contacts 104 exceeds a threshold (e.g., an over-voltage or surge condition), the impedance between contacts 104 (e.g., through the MOV) may be significantly reduced, allowing current to flow (e.g., be shunted) between contacts 104 through device 100. While shunting the current flow, the MOV within device 100 may heat up significantly, a condition that itself could lead to a dangerous failure condition (e.g., damage to the circuitry that device 100 is intended to protect). As discussed below, however, device 100 may prevent current from flowing through device 100 when the MOV reaches a high temperature. As further discussed below, device 100 may prevent arcing within device 100 in a reliable manner.

Figure 2:
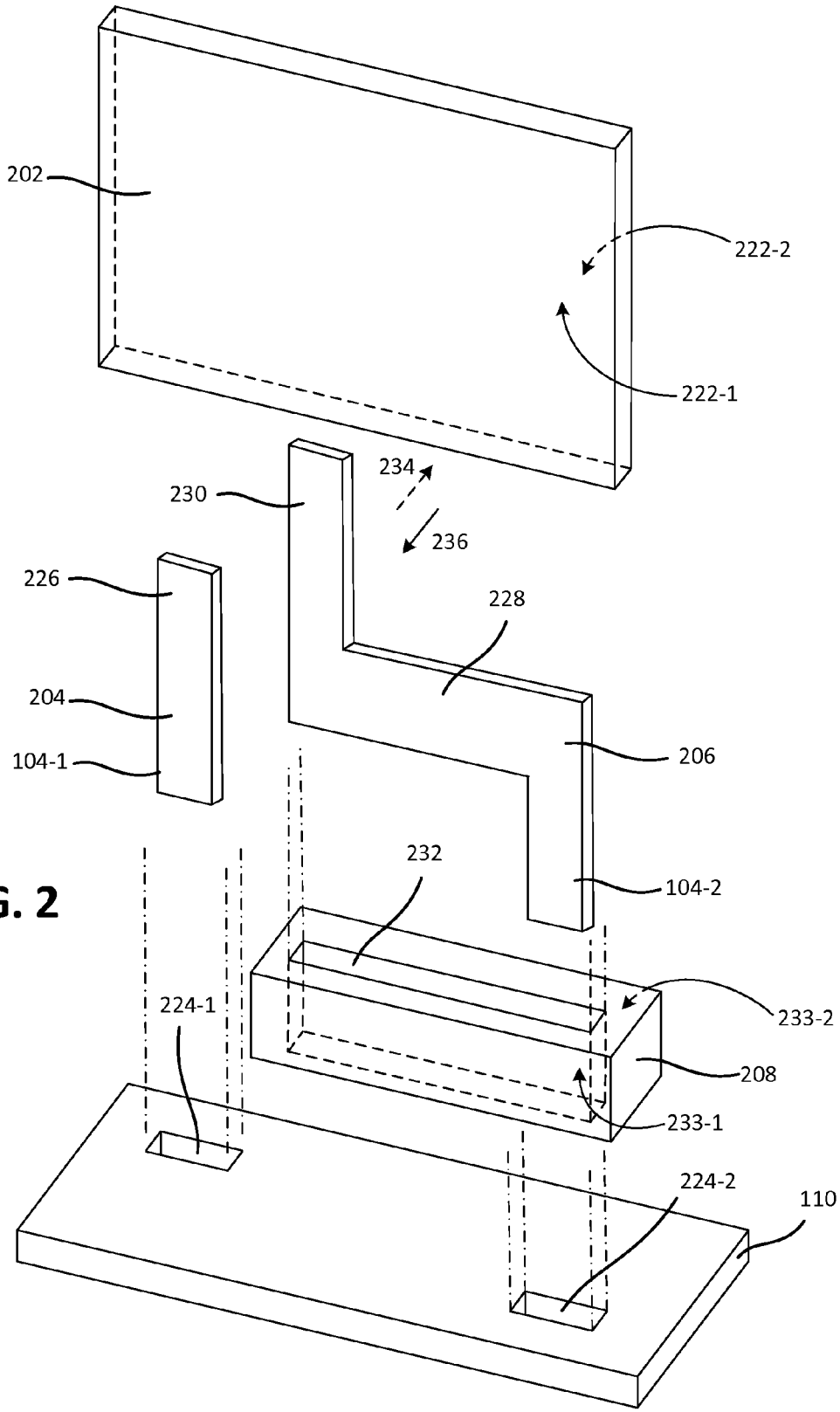
FIG. 2 is an isometric perspective drawing of exemplary components of the surge protective device of FIG. 1 in an unassembled configuration.
Figure 3:
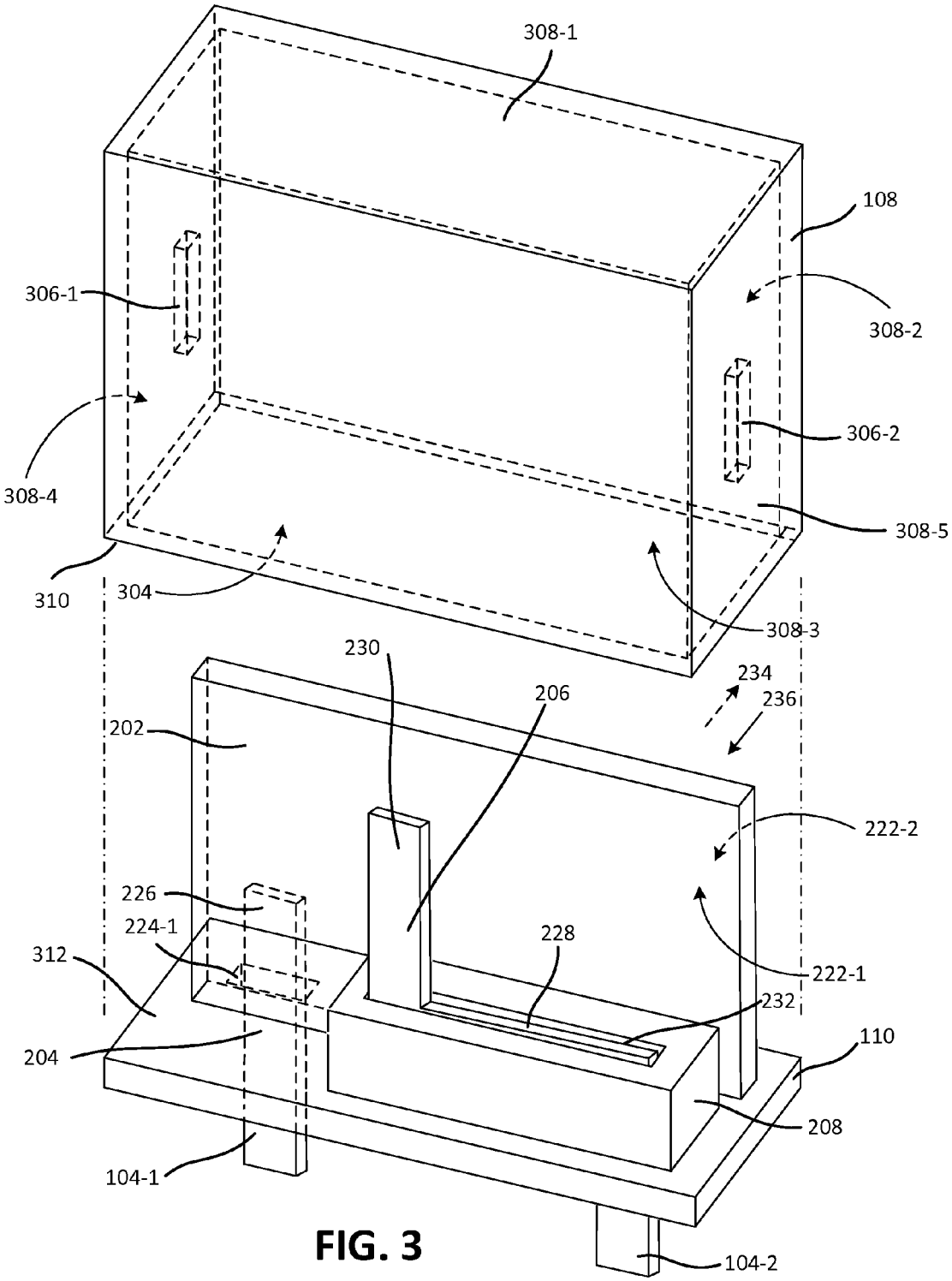
FIG. 3 is an isometric perspective drawing of the exemplary components of the surge protective device of FIG. 1 in a partially assembled configuration.

FIG. 2 is an isometric perspective drawing of exemplary components of device 100 of FIG. 1 in an unassembled configuration. Device 100 may include a metal oxide varistor (MOV) 202, a conductor 204, a conductor 206, a support structure 208, and a base portion 110. FIG. 3 is an additional isometric perspective drawing of the exemplary components shown in FIG. 2, but in a partially assembled configuration.

Base portion 110 may form one wall (e.g., the base) of enclosure 102 of device 100. In one embodiment, base portion 110 may be formed of molded plastic. Base portion may provide support for conductor 204, conductor 206, support structure 208, and/or MOV 202. Base portion 110 may include a first hole 224-1 and a second hole 224-2 (collectively "holes 224"). As shown with dot-dash lines in FIG. 2, first hole 224-1 may allow for a portion of conductor 204 (e.g., first contact 104-1) to pass through base portion 110 and second hole 224-2 may allow for a portion of conductor 206 (e.g., second contact 104-2) to pass through base portion 110. The partially assembled device 100 in FIG. 3 shows contacts 104 extending through holes 224 of base portion 110.

MOV 202 may include a voltage-sensitive element that exhibits high impedance at low voltage and low impedance at high voltages. MOV 202 may include a ceramic mass of zinc oxide grains, in a matrix of other metal oxides, between two metal plates. As shown in FIG. 2, MOV 202 includes a front surface 222-1 and a rear surface 222-2 (collectively surfaces 222). Obstructed edges of MOV 202 are shown with dashed lines. When a voltage applied between surfaces 222 of MOV 202 is less than the breakdown voltage of MOV 202, only a small current flows. When a voltage applied across surfaces 222 of MOV 202 exceeds the breakdown voltage of MOV 202, current flows through MOV 202 from, for example, surface 222-1 to surface 222-2. As discussed above, such current may heat up MOV 202 significantly. Although surfaces 222 of MOV 202 are shown as square, surfaces 222 of MOV 202 may be of other shapes, such as a circular shape.

Front surface 222-1 and rear surface 222-2 may each be covered with a plate of conductive material (not shown), such as copper, aluminum, steel, or a conductive alloy. In this embodiment, current flowing through MOV 202 and heat generated by MOV 202 may be more evenly distributed. The plate or plates of conductive material may be mechanically attached to front surface 222-1, such as with a conductive alloy or adhesive (e.g., solder). In one embodiment, epoxy or polyvinylchloride (PVC) may cover MOV 202 and the plate or plates of conductive material (e.g., around the plate of conductive material on rear surface 222-2 of MOV 202). In this embodiment, the epoxy or PVC may suppress arcing from rear surface 222-2 to finger 230 or from one surface **222-*x* to the other surface 222-*x* of MOV 202**.

Conductor 204 and conductor 206 are comprised of a conductive material, such as metal (e.g., copper, tinned copper, or steel). Conductor 204 includes one end that forms external contact 104-1, as shown in FIGS. 1 and 3, that passes through hole 224-1 of base portion 110. Conductor 204 also includes a second end 226 that may contact rear surface 222-2 of MOV 202. In one embodiment, second end 226 of conductor 204 may form a larger surface area than shown in FIG. 2 such that second end 226 covers a larger portion of rear surface 222-2 of MOV 202. In one embodiment, second end 226 may be attached to, soldered to, or integrally formed with a conductive plate on rear surface 222-2 of MOV 202. In this embodiment, current flowing through MOV 202 and heat generated by MOV 202 may be more evenly distributed. Second end 226 may be attached to MOV 202 with a high temperature, metallic solder such as silver, bismuth, indium, tin, or an alloy of metals. While lead or lead alloys may be used, lead is banned in many countries. In one embodiment, second end 226 may be permanently attached to MOV 202, although in other embodiments, second end 226 may be removably attached to MOV 222.

Conductor 206 includes one end that forms external contact 104-2, as shown in FIGS. 1 to 3, that passes through hole 224-2 of base portion 110. In one embodiment, conductor 206 may be formed of spring steel or spring copper. As shown in FIG. 2, conductor 206 may include a middle portion 228 and a finger portion 230. Middle portion 228 extends between external contact 104-2 and finger portion 230. Middle portion 228 may rest in support structure 208, as shown in FIG. 3 and described below. Finger portion 230 may come into contact with the front surface 222-1 of MOV 202, as described in further detail below.

Support structure 208 may include a front wall 233-1, a rear wall 233-2, and two side walls. The walls of support structure 208 may form a well 232 for holding middle portion 228 of conductor 206. In FIG. 2, obstructed edges of well 232 are shown with dashed lines. FIG. 3 shows support portion 208 attached to base portion 110 and middle portion 228 within well 232. Support portion 208 may be glued to base portion 110. In another embodiment, support portion 208 may be integrally formed with base portion 110. Well 232 may extend entirely through support portion 208 or may extend for only a portion through support portion 208. In one embodiment, support structure 208 may only include rear wall 233-2 without front wall 233-1. In another embodiment, support structure 208 may only include rear wall 232-2 only in the area of finger portion 230. In yet another embodiment, support structure 208 may include rear wall 232-2 and front wall 232-1 only in the area of finger portion 230.

In one embodiment, well 232 may restrict movement of middle portion 228 in a rearward direction (defined by arrow 234) and a forward direction (defined by arrow 236). While middle portion 228 is held by support structure 208, finger portion 230 may move in the rearward direction 234. Such movement may occur when a force is applied in the rearward direction 234, for example. Finger portion 230 may include characteristics of a spring such that removal of the force will return finger 230 to a rest position shown in FIGS. 2 and 3. Support structure 208 may help separate finger portion 230 from MOV 202 when finger portion 230 is in a relaxed position (e.g., help prevent accidental contact between finger portion 230 and MOV 202).

In one embodiment, the rear facing side of support structure 208 may abut against front surface 222-1 of MOV 202. In this embodiment, support structure 208 may also aid in the placement of MOV 202 inside enclosure 102 of device 100. In yet another embodiment, support structure 208 may be omitted entirely and base portion 110 may provide full support for conductor 206.

FIG. 3 also shows a cover portion 108. Cover portion 108 may be made of non-conductive material, such as molded plastic. Cover portion 108 may include a top wall 308-1, a rear wall 308-2, a front wall 308-3, a left side wall 308-4, and a right side wall 308-5 (collectively "walls 308"). As shown in FIG. 3, walls 308 form a cavity 304, where obstructed edges are shown with dashed lines. Cover portion 108 may be moved (e.g., along the dot-dash lines) such that cavity 304 surrounds MOV 202, conductor 204, conductor 206, and support structure 208. In this configuration, the bottom surface 310 of cover portion 108 may come into contact with the top surface of 312 of base portion 110 to form seam 112.

Cover portion 108 may include a first guide rail 306-1 and a second guide rail 306-2 (collectively "guide rails 306"). Guide rails 306 may be formed of non-conductive material, such as plastic. Guide rails 306 may be glued to side walls 308-4 and 308-5 or may be integrally formed with cover portion 108. Guide rails 306 may help guide MOV 202 as cover portion 108 is placed over metal oxide varistor (MOV) 202. In this embodiment, the rear surface of guide rails 306 may come into contact with front surface 222-1 of MOV 202. Thus, MOV 202 may be securely situated between guide rails 306 and rear wall 308-2 of cover portion 108.

In one embodiment, guide rails 306 may extend to top wall 308-1 of cover portion 108 and/or to bottom surface 310 of cover portion 108. In another embodiment, guide rails 306 may extend to front wall 308-3 of cover portion 108, providing a slot in side walls 308-4 and 308-5 for MOV 202.

As mentioned above, bottom surface 310 of cover portion 108 may come into contact with the top surface of 312 of base portion 110 to form seam 112. Seam 112 may be ultrasonically welded or sealed so as to form an air-tight and/or fluid-tight seal between base portion 110 and cover portion 108. Seal 112 may be sealed using other methods, such as with glue, adhesive, or tape. An air-tight and/or fluid-tight seal 112 may prevent escape of a fluid, such as oil, from enclosure 102, as discussed in more detail below.

Figure 4:
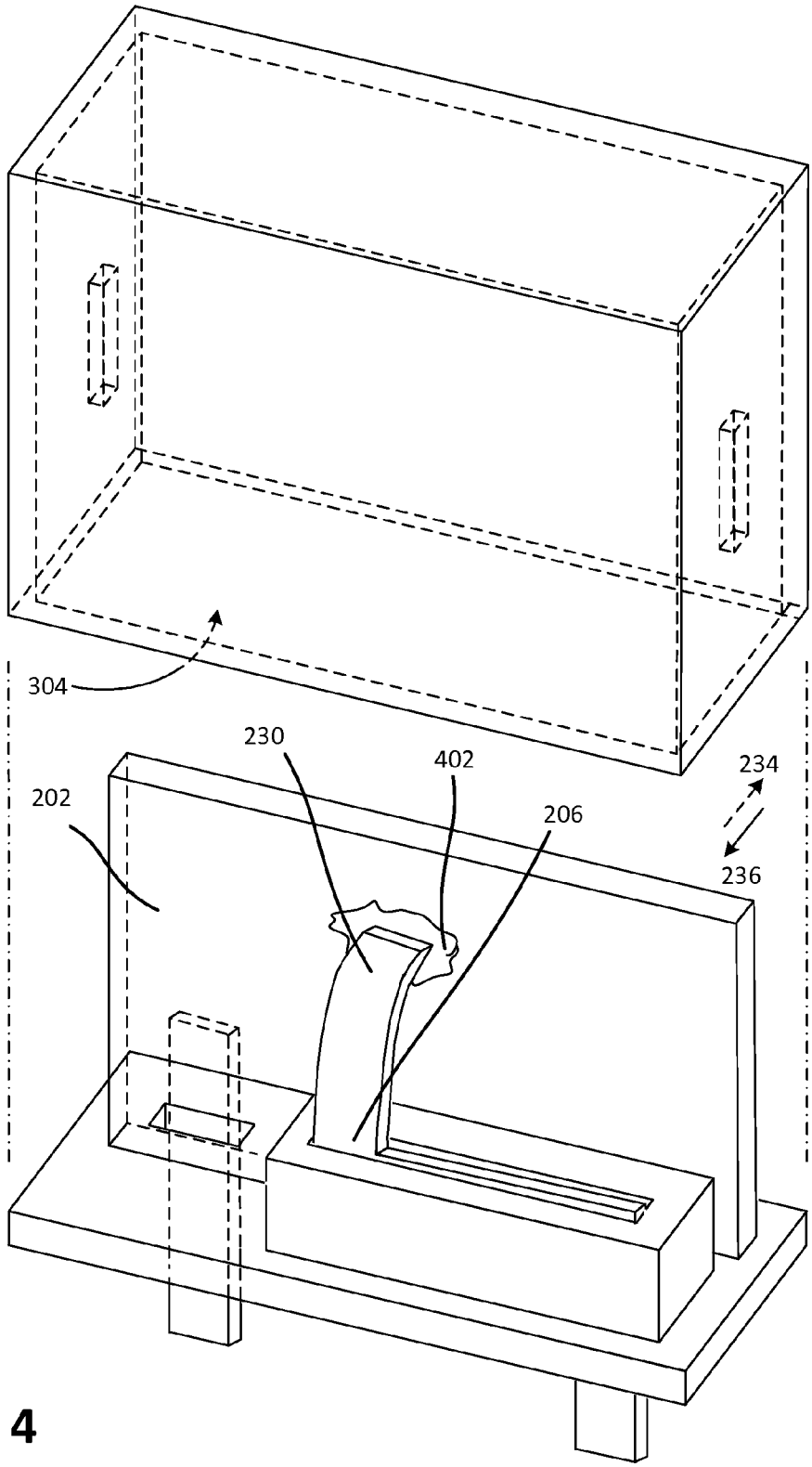
FIG. 4 is an isometric perspective drawing of the exemplary components of the surge protective device of FIG. 1 in another partially assembled configuration.

FIG. 4 is an isometric perspective drawing of the exemplary components of device 100 in another partially assembled configuration. As shown, finger portion 230 of conductor 206 has been moved in the rearward direction 234. In the position shown in FIG. 4, finger portion 230 may store potential energy as a spring. As discussed above, such movement may occur with the application of a force on finger portion 230 in the rearward direction 234. Finger portion 230 may be held in place as shown in FIG. 4 by attaching finger portion 230 to front surface 222-1 of MOV 202. Finger portion 230 may be attached to front surface 222-1 with adhesive 402. As mentioned above, front surface 222-1 of MOV 202 may be covered with a plate of conductive material (not shown). In this embodiment, finger portion 230 is attached the plate of conductive material attached to front surface 222-1 of MOV 202.

Adhesive 402 may be conductive to enhance the electrical contact between finger 230 and front surface 222-1. If adhesive 402 is not conductive, then finger 230 may physically and electrically contact front surface 222-1. Adhesive 402 may include heat-reactive material that loses its adhesive properties (e.g., softens) at a known or predetermined temperature. Adhesive 402 may be metal alloy (e.g. solder), an epoxy, or a polymer (e.g., a conductive polymer). Adhesive 402 may have a relatively low softening or melting temperature. In one embodiment, adhesive 402 is solder (e.g., silver, bismuth, indium, tin, lead, or an alloy of metals). While lead or lead alloys may be used, lead is banned in many countries. Adhesive 402 (e.g., solder) may be a solid at room temperature (e.g., approximately 25 degrees Celsius (° C.)), may be a solid up to 35° C., and may melt at approximately 70 to 140° C. (e.g., 90-95, 96-100, 101-105, 106-110 , 111-115, 116-120, 121-125, 126-130, 131-135, or 136-140° C.). In one embodiment, adhesive 402 may lose its adhesive properties (e.g., has a melting or softening temperature) at approximately 93, 98, 103, 108, 113, 118, 123, 128, 133, or 138° C.

Figure 5A:
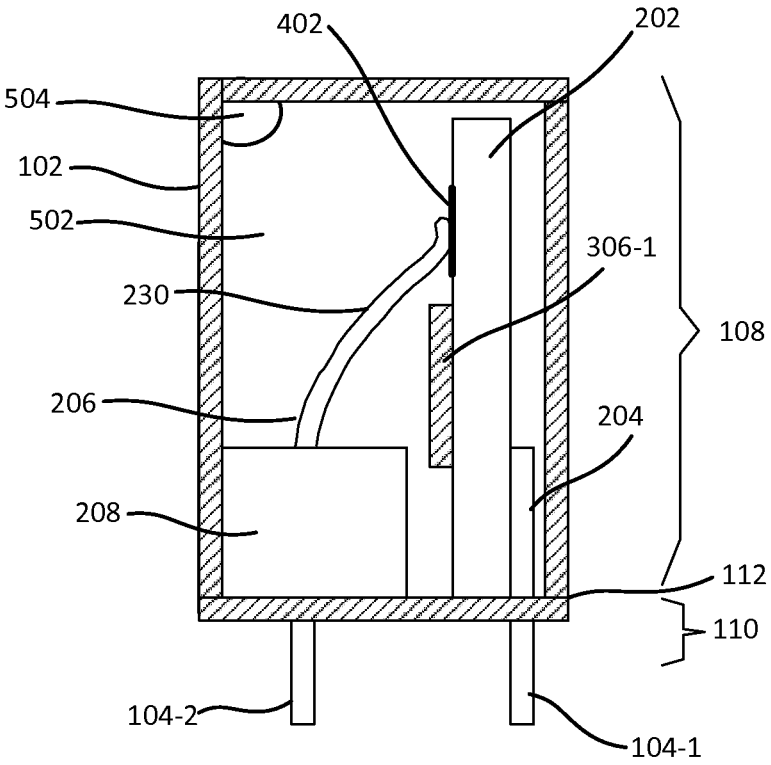
FIG. 5A is a cross-sectional drawing of the surge protective device of FIG. 1 in an assembled configuration.
Figure 5B:
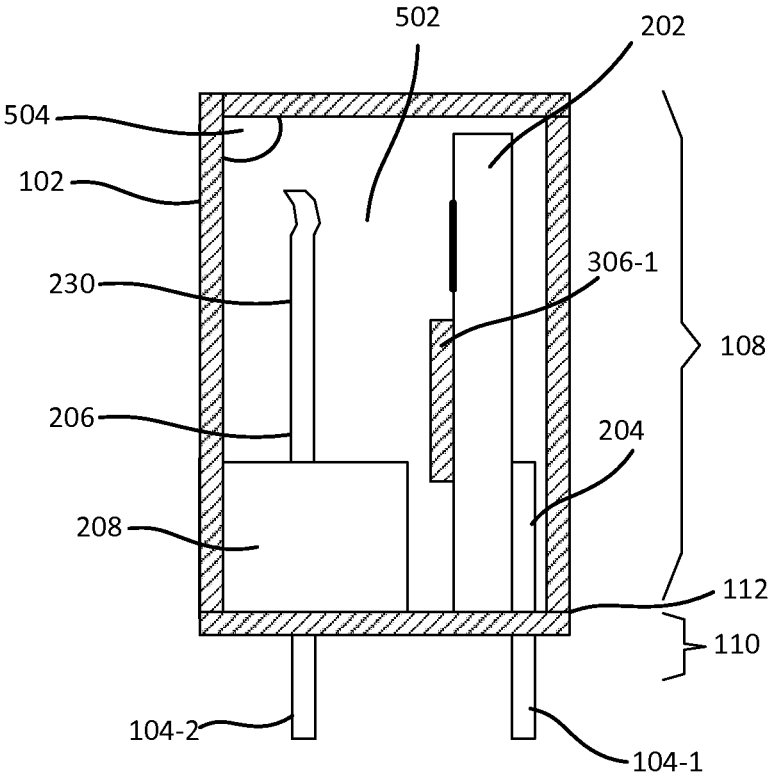
FIG. 5B is a cross-sectional drawing of the surge protective device of FIG. 1 in an assembled, but decoupled configuration.

FIG. 5A is a cross-sectional diagram of device 100 in an assembled configuration. FIG. 5B is a cross-sectional diagram of device 100 in an assembled, but decoupled configuration. As shown in FIG. 5A, finger portion 230 contacts MOV 202 and cover portion 108 extends over MOV 202, support structure 208, conductor 206, and conductor 204. Finger portion 230 is held to MOV 202 by adhesive 402. When there is insufficient voltage between contacts 104, little current flows from conductor 204 through MOV 202 to conductor 206. When there is sufficient voltage between contacts 104, MOV 202 conducts and current is free to flow between contacts 104 and through MOV 202. As discussed above, however, MOV 202 may heat up rapidly. In this situation, when adhesive 402 reaches a sufficiently high temperature, adhesive 402 melts and finger portion 230 returns to its rest position shown in FIG. 5B. As such, when finger portion 230 returns to its rest position, a conductive path no longer exists between contacts 104, thus decoupling device 100 and MOV 202 from the otherwise protected circuit. In other words, adhesive 402 and finger portion 230 act together to "thermally decouple" device 100 from the protected circuit.

Once finger portion 230 has separated from MOV 202, however, there is a danger that an electrical arc may form between finger portion 230 and MOV 202 (e.g., the gap between finger portion 230 and MOV 202). In one embodiment, enclosure 102 may be filled with a non-conductive fluid 502 (e.g., a liquid fluid), such as oil. In this embodiment, when adhesive 402 melts and finger portion 230 moves away from MOV 202, fluid 502 may flow into the space between finger portion 230 and MOV 202, as shown in FIGS. 5A and 5B. Fluid 502 inside enclosure 102 (e.g., between finger portion 230 and MOV 202) may suppress an arc from forming between finger portion 230 and MOV 202 (or between any other components). In one embodiment, fluid 502 may allow an arc to form between finger portion 230 and MOV 202, but may extinguish the arc before it poses a danger or is destructive. In one embodiment, enclosure 102 may be partially filled with a gas 504, such as an inert gas (e.g. helium, neon, argon, krypton, etc.) or free air to allow for deformation (e.g., compression or expansion) of enclosure 102 without rupture, as fluid 502 may not compress as easily under pressure as gas 504. Gas 504 may also suppress arcing in a way similar to fluid 502. Fluid 502 may be considered as include gas 504 (e.g., fluid 502 may include a liquid portion and a gaseous portion).

Fluid 502 may include many different types of oils, including mineral oil, vegetable oil, or seed oils. Fluid 502 may include dielectric insulating fluid, such as BIOTEMP®. Fluid 502 may include fire-resistant fluids, such as Envirotemp™ FR3. FR3 is a soy-based, non-silicone-based fluid. Fluid 502 may meet standards issued by one or more regulatory agencies or professional associations, such as the National Electrical Code (NEC), National Electric Safety Code (NESC), Underwriters Laboratories (UL), the Institute for Electrical and Electronics Engineers (IEEE), Occupational Safety and Health Administration (OSHA), and/or the European Agency for Safety and Health at Work, etc.

Placing fluid 502 in enclosure 102 may allow for device 100 to suppress arcing without moving an arc shield between finger portion 230 and MOV 202. Further, fluid 502 in enclosure 102 may allow for device 100 to suppress arcing without springs to move such an arc shield between finger portion 230 and MOV 202. Thus, placing fluid 502 in enclosure 102 may allow for suppression of an arc more reliably, e.g., without the additional points of failure introduced by an arc shield and springs to move the arc shield. Further, adding an arc shield and springs to move the arc shield may be labor intensive and complex. Thus, placing fluid 502 in enclosure 102 may be simpler than constructing a device 100 with an arc shield and additional springs. A simpler construction may reduce manufacturing costs. Further, a construction with fewer parts (e.g., no arc shield or additional springs) may also reduce manufacturing costs.

Fluid 502 may also promote the more even heating of MOV 202 and device 100. Thus, fluid 502 may prevent "hot spots" on MOV 202, which may, for example, lead to points of premature failure and possibly a catastrophic failure before the melting of adhesive 402. Fluid 502 may also control the rise of temperature of MOV 202, which may extend the life of the device 100 under normal operating conditions. Fluid 502 may also suppress arcing between rear surface 222-2 (or a conductive plate on rear surface 222-2) and finger portion 230 and/or rear surface 222-2 and front surface 222-1 (or conductive plates on surfaces 222). In this embodiment, fluid 502 may allow for the omission of shielding (e.g., PVC or epoxy) around MOV 202 and/or conductive plates on surfaces 222, thus reducing manufacturing time and cost. Further, finger portion 230 may be attached to front surface 222-1 of MOV 202 in places other than the center, such as the top right, the top left, the bottom right, or the bottom left of MOV 202. Attaching finger portion 230 to the top right of MOV 202 may allow for the elimination of middle portion 228 of conductor 206.

In one embodiment, conductor 204 may also be attached to rear surface 222-2 similarly to how conductor 206 is attached to front surface 222-1. In this embodiment, conductor 204 and/or conductor 206 may decouple MOV 202 from a circuit, depending on which conductor 204 or 206 heats up fastest. This configuration may also provide for a more reliable and predictable device. Further, in this embodiment, conductor 204 may be attached to the bottom left of rear surface 222-2 and conductor 206 may be attached to the top right of front surface 222-1; or conductor 204 may be attached to the top left of rear surface 222-2 and conductor 206 may be attached to the bottom right of front surface 222-1, for example.

In one embodiment, a third contact (not shown) may be attached to MOV 202 (e.g., to front surface 222-1) to indicate whether finger portion 230 has been disconnected from the protected circuit. For example, if the protected device is protected by an array of devices (such as device 100), a monitor may determine and be able to display the percentage of devices configured to protect the circuit (e.g., the number of de-coupled devices divided by the total number of devices). In one embodiment, a switch (e.g., a micro switch internal to enclosure 102) may flip from one position to another (e.g., from off to on or from on to off) when finger portion 230 moves from the position shown in FIG. 5A to the position shown in FIG. 5B (e.g., when finger portion 230 becomes decoupled). In this embodiment, the third contact (e.g., external to enclosure 102) may be electrically coupled to the switch and may indicate the state of the switch, and thus the state of finger portion 230 (e.g., whether finger portion 230 is coupled or decoupled). Other monitoring components may also be placed inside enclosure 102 and these components may be coupled to external contacts.

Figure 6:
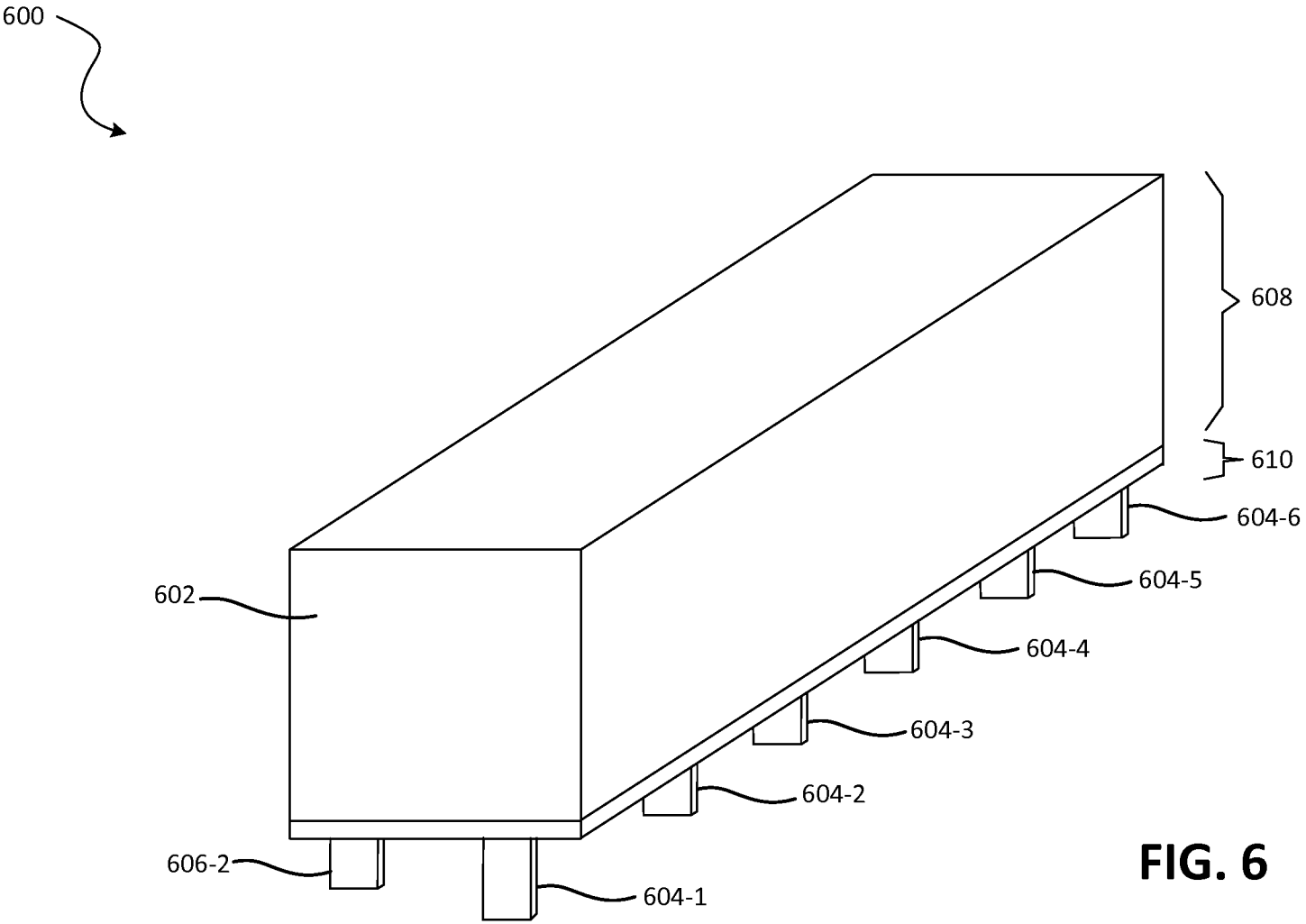
FIG. 6 is an isometric perspective drawing of an exemplary surge protective device in another embodiment in an assembled configuration.

In one embodiment, enclosure 102 may include a plurality of MOVs. For example, FIG. 6 is an isometric perspective drawing of an exemplary surge protective device 600 in an assembled configuration including multiple MOVs. As shown, device 600 includes an enclosure 602 having a cover portion 608 and a base portion 610. Device 600 may include a plurality of first contacts 604-*x* and a plurality of second contacts 606-*x*. Only one of second contacts 606 (e.g., second contact 606-2) appears in FIG. 6, the others being hidden by enclosure 602. Each pair of contacts 606 and 604 may be coupled to a different MOV similar to the coupling described above with respect to FIGS. 2-5. Like enclosure 102, enclosure 602 may be filled with a fluid, such as fluid 502. Fluid 502 may suppress arcs between a surface of each MOV and its respective finger portion, between surfaces of the same MOV, between surfaces of different MOVs, and/or between surfaces of MOVs and conductors coupled or associated with a different MOV.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

Although embodiments above may use an MOV, other devices may be used. For example, any device may be used that has a highly nonlinear current-voltage characteristic, in which the device has a high impedance at low voltages and a low impedance at high voltages. In one embodiment, a gas discharge tube (GDT) may be used instead or in addition to an MOV. A GDT may conduct when the voltage between terminals exceeds a threshold. If a GDT continues to conduct, however, it may overheat, a condition that may cause a catastrophic failure. In this embodiment, the GDT may include conductors that decouple from the GDT at a threshold temperature. The GDT may be surrounded by oil in an enclosure, as described above. In one embodiment, a GDT may be in the same enclosure as a MOV. In other embodiments, a silicon avalanche diode (SAD), a zener diode, a transient suppression diode, a quarter-wave coaxial surge arrestor, a Silicon carbide surge arrestor or varistor (SiCV), and/or a carbon block spark gap overvoltage suppressor may be used additionally or alternatively to an MOV or a GDT. Further still, various combinations of these different protection devices may be in the same enclosure, such as enclosure 602 (e.g., any GDT/MOV combination, any GDT/SAD combination, any MOV/SAD combination, and/or any MOV/SAD/GDT combination).

In one embodiment, conductors 204 and 206 may also act as a fuse. When current through conductor 206 exceeds a threshold, for example, conductor 206 may break. Fluid 502 may serve to suppress arcing across a gap formed at the break of conductor 206. Such a break of conductors 204 or 206 may also be a failure (e.g., unintended failure) condition. In this case, fluid 502 may also act to suppress arcing across a gap formed at the break of conductor 206. Fluid 502 may act to suppress arcing across any gap formed as a result of a failure of components of the surge protection device.

Further, any method of attaching/releasing finger portion 230 to/from the nonlinear device may be used. For example, any method may be used that releases finger portion 230 from the nonlinear device during a thermal and/or low impedance condition.

For example, although one embodiment may include oil in enclosure 102 without the additional components of an arc shield and springs to move the arc shield, alternative embodiments may include these components in addition to oil in enclosure 102. As another example, while a liquid is contemplated for fluid 502, fluid 502 may include a gas to suppress arcing. In one embodiment, fluid 502 is entirely a gas.

Although terms such as "front," "rear," "forward," "backward," "top," "bottom," "left," and "right" are used, these terms are used for convenience to show elements in the figures relative to each other. These terms are not used to indicate absolute direction or position. As such, the terms "rear" and "front" may be interchanged, "top" and "bottom" may interchanged, etc.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A device, comprising:

a metal-oxide varistor (MOV), wherein the MOV increases in temperature as a voltage applied across the MOV exceeds a threshold voltage;

a first conductor electrically coupled to the MOV;

a second conductor electrically coupled to the MOV, wherein the second conductor is configured to electrically decouple from the MOV when the MOV reaches a threshold temperature; and an enclosure to surround the MOV, the first conductor, and the second conductor, wherein the enclosure includes a non-conductive fluid to suppress arcing and to distribute heat on the MOV.

2. The device of claim 1, wherein the non-conductive fluid includes oil that is thermally coupled to a surface of the MOV.

3. The device of claim 1, wherein the non-conductive fluid includes a soy based fluid that is thermally coupled to a surface of the MOV.

4. The device of claim 1, wherein the non-conductive fluid includes a non-silicone-based fluid that is thermally coupled to a surface of the MOV.

5. The device of claim 1, further comprising a heat-reactive metal alloy to couple the second conductor to the MOV, wherein the alloy is configured to soften when the MOV reaches the threshold temperature and wherein the second conductor is configured to spring away and decouple from the MOV when the alloy softens.

6. The device of claim 5, further comprising a structure including a well to support the second conductor, wherein the MOV includes a surface, wherein the second conductor is mechanically coupled to the surface of the MOV at a location other than the center of the surface, and wherein the second conductor is configured to electrically decouple from the surface of the MOV.

7. The device of claim 5, further comprising a gas within the enclosure.

8. The device of claim 5, wherein the enclosure includes a base portion and a cover portion.

9. The device of claim 1, further comprising a heat-reactive epoxy to couple the second conductor to the wherein the epoxy is configured to soften when the MOV reaches the threshold temperature and wherein the second conductor is configured to spring away and decouple from the MOV when the epoxy softens.

10. The device of claim 1, wherein the first conductor is configured to spring away from the MOV when the MOV reaches the threshold temperature.

11. A device, comprising:

a voltage sensitive element fur shunting current when a voltage applied across the voltage sensitive element exceeds a threshold voltage, wherein the voltage sensitive element increases in temperature when the voltage applied across the voltage sensitive element exceeds the threshold voltage;

a first conductor electrically coupled to the voltage sensitive element;

a second conductor electrically coupled to the voltage sensitive element, wherein the second conductor is configured to electrically decouple from the voltage sensitive element when the voltage applied across the voltage sensitive element exceeds the threshold voltage; and an enclosure to surround the voltage sensitive element, the first conductor, and the second conductor, wherein the enclosure includes a non-conductive fluid to suppress arcing and to distribute heat on the voltage sensitive element.

12. The device of claim 11, wherein the non-conductive fluid includes oil.

13. The device of claim 11, wherein the non-conductive fluid includes a soy-based fluid.

14. The device of claim 11, wherein the non-conductive fluid includes a non-silicone-based fluid.

15. The device of claim 11, wherein the voltage sensitive element includes a metal oxide varistor (MOV), wherein the non-conductive fluid is a liquid that is thermally coupled to a surface of the MOV.

16. The device of claim 15, further comprising solder to couple the second conductor to the MOV, wherein the solder is configured to melt when the MOV reaches a threshold temperature and wherein the second conductor is configured to spring away and decouple from the MOV when the solder melts.

17. The device of claim 15, further comprising a structure including a well to support the second conductor, wherein the voltage sensitive element includes a surface, wherein the second conductor is mechanically coupled to the surface of the voltage sensitive element at a location other than the center of the surface, and wherein the second conductor is configured to electrically decouple from the surface of the voltage sensitive element.

18. The device of claim 15, further comprising a gas within the enclosure.

19. The device of claim 15, wherein the enclosure includes a base portion and a cover portion.

20. The device of claim 11, wherein the second conductor is configured to spring away from the voltage sensitive element when the temperature of the voltage sensitive element exceeds a threshold temperature and wherein the non-conductive fluid suppresses arcing between the voltage sensitive element and the second conductor.

21. The device of claim 11, further comprising epoxy to couple the second conductor to the voltage sensitive element, wherein the epoxy is configured to soften when the voltage applied across the voltage sensitive element exceeds the threshold voltage and wherein the second conductor is configured to spring away and decouple from the voltage sensitive element when the solder melts.

22. The device of claim 11, wherein the first conductor is configured to spring away from the voltage sensitive device when the temperature of the voltage sensitive element exceeds a threshold temperature and wherein the non-conductive fluid suppresses arcing between the voltage sensitive element and the first conductor.

* * * * *